US006423186B1

(12) United States Patent
Trokhan et al.

(10) Patent No.: US 6,423,186 B1
(45) **Date of Patent: *Jul. 23, 2002**

(54) APPARATUS AND PROCESS FOR MAKING STRUCTURED PAPER AND STRUCTURED PAPER PRODUCED THEREBY

(75) Inventors: Paul Dennis Trokhan, Hamilton; Dean Van Phan, West Chester; Robert Stanley Ampulski, Fairfield, all of OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/440,372

(22) Filed: Nov. 12, 1999

Related U.S. Application Data

(63) Continuation-in-part of application No. 08/928,388, filed on Sep. 12, 1997, now Pat. No. 6,193,839, which is a division of application No. 08/672,293, filed on Jun. 28, 1996, now Pat. No. 5,776,307, which is a continuation-in-part of application No. 08/460,949, filed on Jun. 5, 1995, now abandoned, which is a continuation-in-part of application No. 08/358,661, filed on Dec. 19, 1994, now Pat. No. 5,637,194, which is a continuation-in-part of application No. 08/170,140, filed on Dec. 20, 1993, now abandoned.

(51) Int. Cl.[7] ..... D21F 5/00
(52) U.S. Cl. ..... 162/280; 162/358.2
(58) Field of Search ..... 162/280, 290, 162/358.1, 358.2, 359.1, 363, 214, 111, 116, 117, 206

(56) References Cited

U.S. PATENT DOCUMENTS

| | | | | |
|---|---|---|---|---|
| 3,214,331 A | * | 10/1965 | Wicker | |
| 3,322,617 A | * | 5/1967 | Osborne | 162/116 |
| 3,537,954 A | | 11/1970 | Justus | 162/305 |
| 3,974,025 A | * | 8/1976 | Ayers | |
| 4,302,282 A | | 11/1981 | Young | 162/111 |
| 4,309,246 A | | 1/1982 | Hulit et al. | 162/113 |
| 4,421,600 A | | 12/1983 | Hostetler | 162/111 |
| 4,482,429 A | * | 11/1984 | Klowak | |
| 5,556,509 A | | 9/1996 | Trokhan et al. | 162/111 |
| 5,580,423 A | | 12/1996 | Ampulski et al. | 162/111.7 |
| 5,609,725 A | | 3/1997 | Phan | 162/117 |
| 5,629,052 A | | 5/1997 | Trokhan et al. | 427/508 |
| 5,637,194 A | | 6/1997 | Ampulski et al. | 162/109 |
| 5,674,663 A | | 10/1997 | McFarland et al. | 430/320 |
| 5,709,775 A | | 1/1998 | Trokhan et al. | 162/117 |
| 5,776,307 A | | 7/1998 | Ampulski et al. | 162/117 |

FOREIGN PATENT DOCUMENTS

| | | |
|---|---|---|
| EP | 0 526 592 B1 | 4/1995 |
| GB | 1 589 800 | 5/1981 |

OTHER PUBLICATIONS

Morrison, R.E., Pulp and Paper—Magazine of Canada pp. 58–62, Feb. 7, 1969.*

* cited by examiner

*Primary Examiner*—Brenda A. Lamb
(74) *Attorney, Agent, or Firm*—Larry L. Huston; Vladimir Vitenberg

(57) ABSTRACT

An apparatus and process for imprinting a web. A yankee drum and pressure roll are juxtaposed to form a nip. An imprinting member, such as through air drying belt or other patterning belt is interposed in the nip. A felt is also interposed in the nip, contacting the backside of the imprinting member. The imprinting member carries a paper web. The paper web is imprinted in the nip and simultaneously transferred to the yankee drying drum. The nip may be formed with a vacuum roll juxtaposed with the felt. The vacuum roll may remove water from the felt and hence the web.

10 Claims, 2 Drawing Sheets

APPARATUS AND PROCESS FOR MAKING STRUCTURED PAPER AND STRUCTURED PAPER PRODUCED THEREBY

CROSS REFERENCE TO RELATED APPLICATIONS

This application is a continuation-in-part of Ser. No. 08/928,388, filed Sep. 12, 1997, now U.S. Pat. No. 6,193,839, issued Feb. 27, 2001 which is divisional of Serial No. 08/672,293, filed June 28, 1996, now U.S. Pat. No. 5,776,307, iss. Jul. 7, 1998, which is a continuation-in-part of Ser. No. 08/460,949, filed Jun. 5, 1995, abandoned, which is a continuation-in-part of Ser. No. 08/358,661, filed Dec. 19, 1994, now U.S. Pat. No. 5,637,194, iss. Jun. 10, 1997, which is a continuation-in-part of Ser. No. 08/170,140, filed Dec. 20, 1993, abandoned.

FIELD OF THE INVENTION

The present invention relates to papermaking, and more particularly to papermaking which yields paper having regions of different regions, such as density, caliper, crepe, amplitude, etc.

BACKGROUND OF THE INVENTION

Papermaking is a well known art. In papermaking cellulosic fibers and a liquid carrier are mixed together. The liquid carrier is drained away and the resulting embryonic web of cellulosic fibers is dried.

Drying is typically accomplished in one of two manners, through air drying or conventional drying. Through air drying relies upon blowing hot air through the embryonic web. Conventional drying relies upon a press felt to remove water from the web by capillary action.

Through air drying yields paper having regions of different densities. This type of paper has been used in commercially successful products, such as Bounty paper towels and Charmin and Charmin Ultra brands of bath tissues. However, there are or may be situations where one does not wish to utilize through air drying.

In these situations, conventional felt drying is used. However, conventional felt drying does not necessarily produce the structured paper and its attendant advantages. Accordingly, it has been desired to produce structured paper using conventional felt drying. This has been accomplished utilizing a conventional felt having a patterned framework thereon for imprinting the embryonic web. Examples of these attempts in the art include commonly assigned U.S. Pat. No. 5,556,509, issued Sep. 17, 1996 to Trokhan et al.; U.S. Pat. No. 5,580,423, issued Dec. 3, 1996 to Ampulski et al.; U.S. Pat. No. 5,609,725, issued Mar. 11, 1997 to Phan; U.S. Pat. No. 5,629,052, issued May 13, 1997 to Trokhan et al.; U.S. Pat. No. 5,637,194, issued Jun. 10, 1997 to Ampulski et al.; U.S. Pat. No. 5,674,663, issued Oct. 7, 1997 to McFarland et al.; and U.S. Pat. No. 5,709,775 issued Jan. 20, 1998 to Trokhan et al., the disclosures of which are incorporated herein by reference.

However, there may be occasions when one wishes to use a conventional felt without a patterned framework thereon. Such flexibility in the manufacturing process is provided by the present invention.

U.S. Pat. No. 4,421,600 issued Dec. 20, 1983 to Hostetler discloses an apparatus having two felts, and three pressing operations. Again, after pressing the web is transferred on a woven imprinting fabric to the Yankee dryer.

Such an attempt in the art is illustrated by U.S. Pat. No. 4,309,246 issued Jan. 5, 1982 to Hulit et al. Hulit et al. describes three configurations where a nip is formed between two rolls. In each configuration, an imprinting fabric and a felt are interposed between the rolls. A paper web is carried on the imprinting fabric and imprinted by the imprinting fabric. Hulit then carries the web from this nip on the imprinting fabric. In two embodiments, Hulit then transfers the web from the imprinting fabric to a Yankee drying drum. In the third embodiment, Hulit does not use a Yankee drying drum.

The Hulit arrangement have several disadvantages. First, two sets of nips are required, a first nip to imprint the web and a second nip where the web is transferred to the Yankee drying drum, Hulit recognizes that dryer drums may be utilized instead of, or in addition to, the Yankee drying drum. However, Hulit does not minimize the expense and inconvenience of requiring two separate nips for the configurations relying upon the Yankee drying drum—as most commonly occurs in the art.

Furthermore, by imprinting the paper web in a first operation, and transferring the paper web to the Yankee drying drum in a second operation, Hulit creates caliper in one operation which he destroys in a subsequent operation. Compaction of Hulit's web necessarily occurs between the compression roll and the Yankee dryer. This compaction destroys the caliper that was built in by imprinting the web in the first place.

Another attempt is shown in European Patent 0 526 592 B1 granted Apr. 5, 1995 to Erikson et al. Erikson et al. discloses another two nip configuration. In the first nip, the paper is imprinted between a the press roll and a lower press roll. There, Erikson et al. dewaters the paper by placing the press felt directly against the paper. This allows the press felt to deform into the areas of the imprinting fabric not supported by knuckles, reducing the differential density effects of the compaction caused by the imprinting fabric.

Erikson imprints the paper and transfers it to the Yankee at a lower press roll. The paper is transferred to the Yankee drying drum at this point. However, the second press drum again imprints the paper. The problem presented by the Erikson et al. is that its second nip the imprinting belt is never in registration with the imprinted pattern provided at the first nip. Thus, Erikson unduly compacts the paper and destroys the caliper it creates by imprinting at the first nip.

Furthermore, Erikson et al. like the aforementioned attempts in the art, still requires a complex two nip system. Erikson also requires the press felt loop to be outboard of the imprinting fabric loop. This arrangement creates a very expensive proposition for retrofit to existing machinery, as additional space, drives, etc. are required to add the separate felt loop. The cost of installing such a separate felt loop on an existing papermaking machine is estimated to be in excess of $10 million.

Commonly assigned U.S. Pat. No. 5,637,194 issued Jun. 10, 1997 to Ampulski et al., the disclosure of which is incorporated herein by reference, discloses an alternative paper machine embodiment where a felt is positioned adjacent a face of the imprinting member. The imprinting members imprints the molded web and carries it to the Yankee drying drum. Ampulski et al. teaches that the imprinting member is useable for through-air drying and the web is molded into the imprinting member. While Ampulski et al. represents a significant improvement over the prior art, Ampulski et al. still does not provide full contact of the web against the Yankee drying drum.

SUMMARY OF THE INVENTION

The invention comprises a papermaking apparatus. The apparatus has first and second rigid surfaces juxtaposed to form a nip therebetween. An imprinting member is interposable in the nip and carries a web. The imprinting member has a sheet side for contacting the web and an opposed backside. The web is in contacting relationship with the first rigid surface whereby the web can be simultaneously imprinted and transferred to the first rigid surface.

A capillary dewatering member is also interposable in the nip and is contacting relationship with the second rigid surface and with the backside of the imprinting member. A compressive force can be simultaneously applied to the web, the imprinting member and the capillary dewatering member through the nip.

In a preferred embodiment, the nip is formed by two coaxial rolls. One of the rolls may be a Yankee drying drum, the other roll may be a pressure roll and more preferably a vacuum pressure roll.

DETAILED DESCRIPTION OF THE INVENTION

Figure 1:
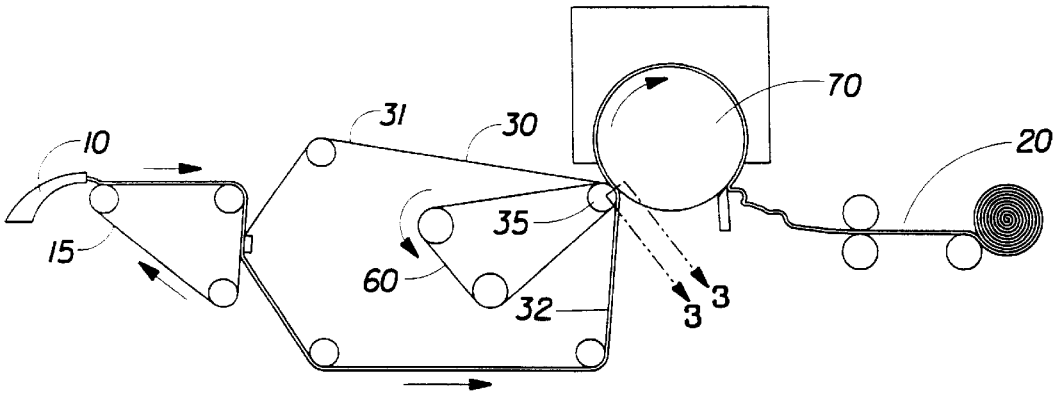
FIG. 1 is a vertical side elevational view of a papermaking machine according to the present invention.
Figure 2:
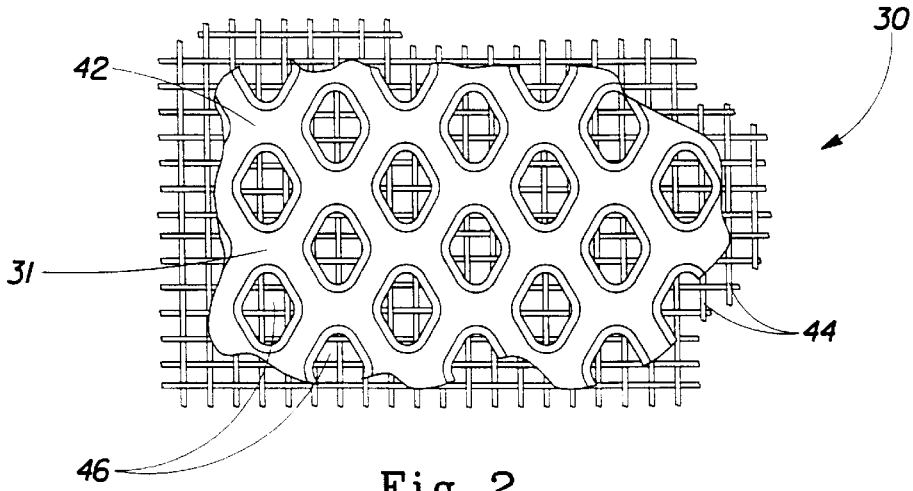
FIG. 2 is a fragmentary top plan view of the imprinting member shown in FIG. 1.
Figure 3:
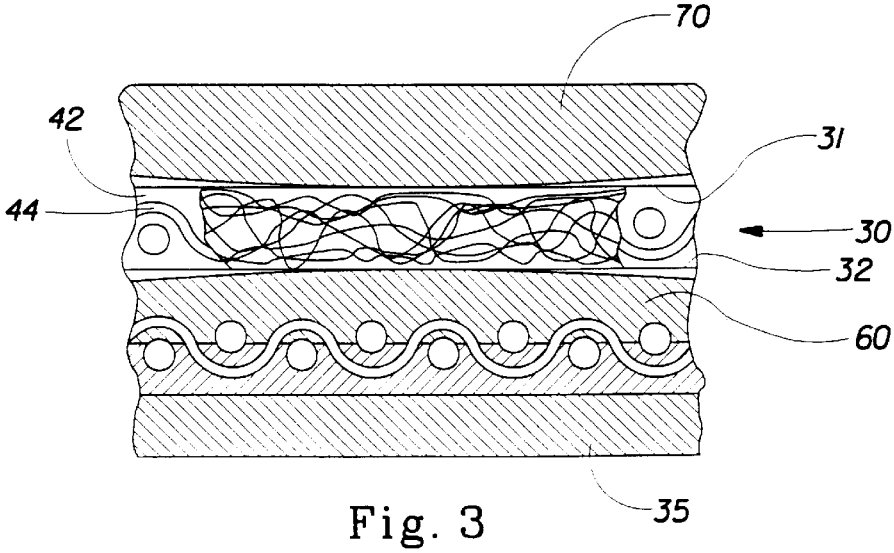
FIG. 3 is a vertical sectional view taken along lines 3—3 of FIG. 1.

Referring to FIG. 1, the present invention begins with an aqueous dispersion of fibers deposited from a headbox 10 as is well known in the art. The aqueous dispersion of fibers yields a paper 20 which may be of constant basis weight or may comprise multiple basis weights.

If desired, the paper 20 may have multiple basis weights. Preferably the multiple basis weight paper 20 has two or more distinguishable regions: regions with a relatively high basis weight, and regions with a relatively low basis weight. Preferably the high basis weight regions comprise an essentially continuous network. The low basis weight regions may be discrete. If desired, the paper 20 according to present invention may also comprise intermediate basis weight regions disposed within the low basis weight regions. Such paper 20 may be made according to commonly assigned U.S. Pat. No. 5,245,025, issued Sep. 14, 1993 to Trokhan et al., the disclosure of which is incorporated herein by reference. If the paper 20 has only two different basis weight regions, an essentially continuous high basis weight region, with discrete low basis weight regions disposed throughout the essentially continuous high basis weight region, such paper 20 may be made according to commonly assigned U.S. Pat. No. 5,527,428 issued Jun. 18, 1996 to Trokhan et al.; U.S. Pat. No. 5,534,326 issued Jul. 9, 1996 to Trokhan et al.; and U.S. Pat. No. 5,654,076, issued Aug. 5, 1997 to Trokhan et al., the disclosures of which are incorporated herein by reference.

One may further wish to densify selected regions of the paper 20. Such paper 20 will have both multiple density regions and multiple basis weight regions. Such paper 20 may be made according to commonly assigned U.S. Pat. No. 5,277,761, issued Jan. 11, 1994 to Phan et al.; and U.S. Pat. No. 5,443,691, issued Aug. 22, 1995 to Phan et al., the disclosures of which are incorporated herein by reference.

The forming wire 15 used to make the aforementioned multibasis weight paper 20 may comprise a plurality of protuberances. The protuberances are upstanding from the plane of the forming wire 15 and are preferably discrete. The protuberances obturate drainage through selected regions of the forming wire 15, producing low and high basis weight regions in the paper 20, respectively. The forming wire 15 for use with the present invention may be made according to commonly assigned U.S. Pat. No. 5,503,715, issued Apr. 2, 1996 to Trokhan et al. and U.S. Pat. No. 5,614,061, issued Mar. 25, 1997 to Phan et al., the disclosures of which are incorporated herein by reference.

The paper is transferred from the forming wire 15 to an imprinting belt 30. The imprinting belt 30 like the forming wire 15, is macroscopically monoplanar. The plane of the imprinting belt 30 defines its X-Y directions. Perpendicular to the X-Y directions and the plane of the imprinting belt 30 is the Z-direction of the belt 30. Likewise, the paper 20 according to the present invention can be thought of as macroscopically monoplanar and lying in an X-Y plane. Perpendicular to the X-Y directions and the plane of the paper 20 is the Z-direction of the paper 20.

The first surface 31 of the imprinting belt 30 contacts the paper 20 carried thereon. During papermaking, the first surface 31 of the imprinting belt 30 may imprint a pattern onto the paper 20 corresponding to the pattern of a framework 42.

The second surface 32 of the imprinting belt 30 is the machine contacting surface of the belt 10. The second surface 32 may be made with a backside network having passageways therein which are distinct from deflection conduits 46 through the belt 30. The passageways provide irregularities in the texture of the backside of the second surface 32 of the belt 30. The passageways allow for air leakage in the X-Y plane of the belt 30, which leakage does not necessarily flow in the Z-direction through the deflection conduits 46 of the belt 30.

Alternatively, the imprinting belt 30 may have discontinuous knuckles. The discontinuous knuckles made by a particular weave of warp and weft yarns. The paper 20 made on such an imprinting belt will have a like pattern of discrete imprinted areas. Imprinting belts, which are also used for through air drying, and known to be suitable for this purpose are illustrated in commonly assigned U.S. Pat. No. 3,301,746 issued Jan. 31, 1967 to Sanford et al.; U.S. Pat. No. 3,905,863 issued Sep. 16, 1975 to Ayers; and U.S. Pat. No. 4,239,065 issued Dec. 16, 1982 to Trokhan, the disclosures of which are incorporated herein by reference.

If desired, the imprinting belt 30 used for the present invention may be woven on a Jacquard loom. The Jacquard loom is alleged to have the advantage of providing flexibility in the resulting belt. Examples of belts woven on Jacquard wounds are disclosed in U.S. Pat. No. 5,672,248 issued to Farrington.

Preferably, the imprinting belt 30 according to the present invention comprises two primary components, a framework 42 and a reinforcing structure 44. The framework 42 preferably comprises a polymeric resin. The framework 42 and imprinting belt 30 have a first surface 31 which defines the paper contacting side of the belt 30 and an opposed second surface 32 oriented towards the papermaking machine on which the belt 30 is used.

Preferably the framework 42 defines a predetermined pattern, which imprints a like pattern onto the paper 20 of the present invention. A particularly preferred pattern for the framework 12 is an essentially continuous network. If the preferred essentially continuous network pattern is selected for the framework 42, discrete conduits 46 will extend between the first surface 31 and the second surface 32 of the imprinting belt 30. The essentially continuous network surrounds and defines the conduits 46.

The second primary component of the belt 30 according to the present invention is the reinforcing structure 44. The reinforcing structure 44, like the framework 42, has a first or paper facing side and a second or machine facing surface opposite the paper facing surface. The reinforcing structure 44 is primarily disposed between the opposed surfaces of the belt 30 and may have a surface coincident the backside of the belt 30. The reinforcing structure 44 provides support for the framework 42. The reinforcing structure 44 is typically woven, as is well known in the art. The portions of the reinforcing structure 44 registered with the deflection conduits 46 prevent fibers used in papermaking from passing completely through the deflection conduits 46 and thereby reduces the occurrences of pinholes. If one does not wish to use a woven fabric for the reinforcing structure 44, a nonwoven element, screen, net, or a plate having a plurality of holes therethrough may provide adequate strength and support for the framework 42 of the present invention.

The imprinting belt 30 according to the present invention may be made according to any of commonly assigned U.S. Pat. No. : 4,514,345, issued Apr. 30, 1985 to Johnson et al.; U.S. Pat. No. 4,528,239, issued Jul. 9, 1985 to Trokhan; U.S. Pat. No. 5,098,522, issued Mar. 24, 1992; U.S. Pat. No. 5,260,171, issued Nov. 9, 1993 to Smurkoski et al.; U.S. Pat. No. 5,275,700, issued Jan. 4, 1994 to Trokhan; U.S. Pat. No. 5,328,565, issued Jul. 12, 1994 to Rasch et al.; U.S. Pat. No. 5,334,289, issued Aug. 2, 1994 to Trokhan et al.; U.S. Pat. No. 5,431,786, issued Jul. 11, 1995 to Rasch et al.; U.S. Pat. No. 5,496,624, issued Mar. 5, 1996 to Stelljes, Jr. et al.; U.S. Pat. No. 5,500,277, issued Mar. 19, 1996 to Trokhan et al.; U.S. Pat. No. 5,514,523, issued May 7, 1996 to Trokhan et al.; U.S. Pat. No. 5,554,467, issued Sep. 10, 1996, to Trokhan et al.; U.S. Pat. No. 5,566,724, issued Oct. 22, 1996 to Trokhan et al.; U.S. Pat. No. 5,624,790, issued Apr. 29, 1997 to Trokhan et al.; and U.S. Pat. No. 5,628,876, issued May 13, 1997 to Ayers et al., the disclosures of which are incorporated herein by reference.

Preferably, the framework 42 extends outwardly from the reinforcing structure 44 a distance of less than about 0.15 millimeters, more preferably less than about 0.10 millimeters and still more preferably less than about 0.05 millimeters. Still more preferably the patterned framework 42 is approximately coincident the elevation of the reinforcing structure 44. By having the patterned framework 42 extending outwardly such a small distance from the reinforcing structure 44. By having the patterned framework 42 extending outwardly such a small distance from the reinforcing structure 44, a softer product may be produced. Specifically, this provides for the absence of deflection or molding of the paper 20 into the imprinting belt 30 as occurs in the prior art. Thus, the resulting paper 20 will have a smoother surface and less tactile roughness.

Furthermore, by having the framework 42 extend outwardly from the reinforcing structure 44 such a short distance, the reinforcing structure 44 will contact the paper at top surface knuckles disposed within the deflection conduits 46. This arrangement further compacts the paper 20 at the points coincident the knuckles against the Yankee drying drum 70, decreasing the XY spacing between compacted regions.

Thus, greater contact between the paper 20 and the Yankee 70 occurs. As noted above, one of the benefits of the present invention is that the imprinting of the paper 20 and transfer to the Yankee 70 occur simultaneously, eliminating the multioperational steps of the prior art. By transferring substantially full contact of the paper 20 to the Yankee 70—rather than just compacted knuckles as occurs in the prior art—full contact drying can be obtained. Furthermore, by simultaneously imprinting the paper 20 and transferring it to the Yankee 70 caliper is maintained.

The prior art attempts imprinted in one operation and transferred to the Yankee 70 in a second operation. The second operation, with its own separation nip, compacts the paper 20—destroying the caliper imparted to the paper 20 at the first nip. The present operation simultaneously imprints and transfers thus obviating this problem.

The paper 20 may also be foreshortened, as is known in the art. Foreshortening can be accomplished by creping the paper 20 from a rigid surface, and preferably from a cylinder. A Yankee drying drum 70 is commonly used for this purpose. Creping is accomplished with a doctor blade as is well known in the art. Creping may be accomplished according to commonly assigned U.S. Pat. No. 4,919,756, issued Apr. 24, 1992 to Sawdai, the disclosure of which is incorporated herein by reference. Alternatively or additionally, foreshortening may be accomplished via wet microcontraction as taught in commonly assigned U.S. Pat. No. 4,440,597, issued Apr. 3, 1984 to Wells et al., the disclosure of which is incorporated herein by reference. The creping blade will selectively and differentially crepe the compacted and relatively noncompacted areas of the paper 20.

In the present invention, a conventional felt 60 is juxtaposed with the backside of the imprinting belt 30. The conventional felt 60 has a surface batting with a denier of less than 5, and preferably less than 3. This surface batting contacts the imprinting belt 30 during papermaking. The felt 60 may have a basis weight of 200 to 1400 grams per square meter. Preferably, the felt 60 does not have a separate pattern thereon, so that the first surface 31 of the felt 70 directly and completely contacts the backside of the imprinting belt 30. This contact assists in water removal from the imprinting belt 30 and hence from the paper 20. However, if desired, the felt 60 may be provided with a patterned framework thereon, as disclosed in the aforementioned patents incorporated herein by reference.

It is important that a hydraulic connection be made, in turn, between the paper 20, the imprinting belt 30, and the felt 60. The hydraulic connection can be improved in several ways. First, the felt 60 can be compacted. Compacting the felt 60 decreases the average volume of the pores of the felt 60. Preferably, the felt 60 will have an average pore volume distribution of less than 50 microns.

A suitable press felt 60 is an Ampfex 2 manufactured by the Appleton Mills Company of Appleton, Wis. Such a felt 60 has a thickness of about 2–5 millimeters, and a basis weight of 800 to 2000 grams per square meter, and an average density of 0.16 to 1.0 grams per cubic centimeter. The felt 60 may have an air permeability between about 5 and about 300 SCFM per square foot, with an air impermeability of less than 50 SCFM per square foot being preferred for use with the present invention.

Additionally to improve the hydraulic connection, the imprinting belt 30 may have a batting needled therethrough. The batting may extend outwardly from both the machine facing surface 32 and the sheet facing surface 31 of the imprinting belt 30. More preferably the batting extends outwardly from the backside of the belt 30 so that intimate contact with the felt 60 is provided. If desired, the imprinting member 30 having the batting thereon may be compacted to decrease its average pore volume distribution.

Compaction to decrease pore volume distribution of either a batted imprinting member 30 or the felt 60 can be accomplished by a calendar nip, as is known in the art. Preferably, the average pore volume distribution monotonically decreases from the paper 20 to the added imprinting member 30 to the capillary felt 60. Such a monotonic decrease provides a thermodynamic attraction which assists in removing water from the paper 20 to be dried.

If desired, other capillary dewatering members may be used in place of the felt 60 described above. For example, a foam capillary dewatering member may be selected. Preferably such a foam has an average pore size of less than 50 microns. Suitable foams may be made in accordance with commonly assigned U.S. Pat. No. 5,260,345 issued Nov. 9, 1993 to DesMarais et al. and U.S. Pat. No. 5,625,222 issued Jul. 22, 1997 to DesMarais et al., the disclosures of which are incorporated herein by reference.

Alternatively, a limiting orifice drying medium may be used as capillary dewatering member. Such a medium may be made of various laminae, superimposed in face to face relationship. The laminae have an interstitial flow area smaller than that of the interstitial areas between fibers in the paper. A suitable limiting orifice drying member may be made in accordance with commonly assigned U.S. Pat. No. 5,625,961 issued May 6, 1997 to Ensign et al. and U.S. Pat. No. 5,274,930 issued Jan. 4, 1994 to Ensign et al., the disclosures of which are incorporated herein by reference.

The felt 60, imprinting member 30, and paper 20 are interposed in a nip. Preferably, the nip is formed between two coaxial rolls. More preferably, one of the rolls is heated, and still more preferably comprises a heated Yankee drying drum 70. The other of the rolls 35 may be a vacuum pressure roll.

The felt 60, imprinting belt 30 and paper 20 are interposed in the nip such that the paper 20 is adjacent the heated roll, preferably the heated drying drum and more preferably a Yankee drying drum 70. The imprinting belt 30 is juxtaposed with and in contacting relationship with the paper 20. The felt 60 is juxtaposed and in contacting relationship with the backside of the imprinting belt 30 and the periphery of the other, or second, roll 35.

If desired, a vacuum may be applied through the second roll 35 to the felt. This vacuum assists in water removal from the felt 60, and hence from the paper 20. The second roll 35 may be a vacuum pressure roll. Preferably, a steam box is disposed opposite the vacuum pressure roll 35. A steam box ejects steam through the paper 20. As the steam passes through the paper 20, it reduces the viscosity of water contained therein, promoting better drying. The steam is collected by the vacuum pressure roll 35.

If further desired, a vacuum box may be substituted for the vacuum pressure roll 35. The vacuum box will allow for a positive draw of air, and hence water, through the paper 20 at the position where the paper 20 is transferred to the Yankee drying drum 70.

Of course, one of ordinary skill will recognize that the simultaneous imprinting, dewatering and transfer operations may occur in embodiments other than these requiring a Yankee drying drum. For example, two flat surfaces may be juxtaposed together to form an elongate nip therebetween. Alternatively, two rolls may be utilized, neither of which roll is heated. The rolls may be, for example, part of a calendar stack, or an operation which prints a functional additive onto the surface of the web. Functional additives include: lotions emollients, dimethicones, softeners, perfumes, menthols, etc. which are well known in the art.

Figure 4:
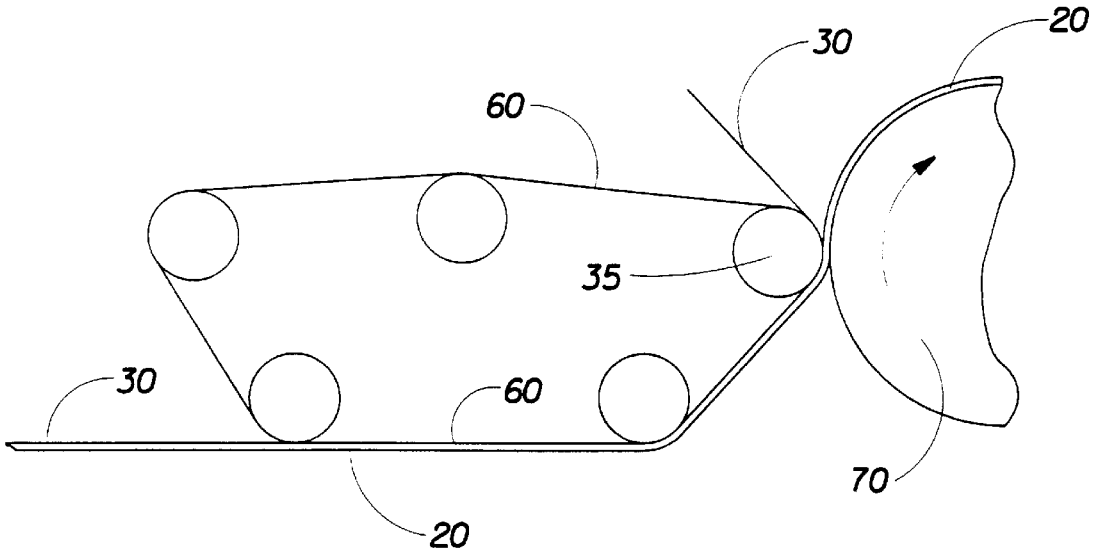
FIG. 4 is a fragmentary vertical side elevational view of an alternative embodiment of a papermaking machine according to the present invention.

Referring to FIG. 4, if desired, the capillary dewatering member 60 may comprise an extended loop. The extended loop is nested with the imprinting member 30 as illustrated in FIG. 1. However, the extended nested loop of FIG. 4 provides the advantage that dewatering can occur at a first nip, with subsequent dewatering and transfer occurring at a second nip. However, the total number of clothings required for the embodiment of FIG. 4 does not increase over that shown in FIG. 1.

One of ordinary skill will recognize that many other variations and permutations are feasible. For example, a single roll and an elongate flat surface may be combined to form a nip therebetween. However, it is only with the present invention that the simultaneous three functions of dewatering the web and/or the capillary dewatering member by compression, imprinting the web, and transferring the web from the imprinting member can simultaneously occur. All such apparatuses and processes are within the scope of the appended claims.

What is claimed is:

1. A papermaking apparatus for drying a web and comprising a Yankee drying drum and a pressure roll juxtaposed to form a first nip therebetween;

an imprinting member in the form of an endless belt and being interposed in said first nip, said imprinting member comprising a reinforcing element and a patterned framework extending outwardly therefrom, said patterned framework contacting and imprinting said web in said first nip, said web simultaneously contacting and being transferred to said Yankee drying drum, said patterned framework comprising a photosensitive resin; and a capillary dewatering member, said capillary dewatering member being in the form of an endless belt nested inside said imprinting member, said capillary dewatering member being juxtaposed with said pressure roll in said first nip, whereby said capillary dewatering member can dewater said imprinting member in said first nip.

2. The apparatus according to claim 1, wherein the pressure roll comprises a vacuum roll structured to apply vacuum to the capillary dewatering member.

3. The apparatus according to claim 1, wherein the capillary dewatering member comprises a woven felt.

4. The apparatus according to claim 3, wherein the capillary dewatering member has a denier of less than about 5.

5. The apparatus according to claim 1, wherein the imprinting member comprises a woven belt.

6. The apparatus according to claim 1, wherein the woven reinforcing structure comprises a foraminous belt.

7. The apparatus according to claim 1, wherein the patterned framework extends outwardly from the reinforcing element to a distance less than 0.15 millimeters.

8. The apparatus according to claim 7, wherein the patterned framework extends outwardly from the reinforcing element to a distance less than 0.05 millimeters.

9. The apparatus according to claim 1, wherein the pressure roll comprises a vacuum pressure roll.

10. A papermaking apparatus for drying a web and comprising a Yankee drying drum and a pressure roll juxtaposed to form a first nip therebetween;

an imprinting member in the form of an endless woven belt and being interposed in said first nip, said imprinting member comprising a reinforcing element and a patterned framework extending outwardly therefrom, said patterned framework contacting and imprinting said web in said first nip, said web simultaneously contacting and being transferred to said Yankee drying drum, wherein the imprinting member comprises a Jacquard weave; and a capillary dewatering member, said capillary dewatering member being in the form of an endless belt nested inside said imprinting member, said capillary dewatering member being juxtaposed with said pressure roll in said first nip, whereby said capillary dewatering member can dewater said imprinting member in said first nip.

* * * * *